US010487639B2

(12) United States Patent
Webber

(10) Patent No.: US 10,487,639 B2
(45) Date of Patent: Nov. 26, 2019

(54) SANDGUARD FOR A PROGRESSIVE CAVITY PUMP

(71) Applicant: FORUM US, INC., Houston, TX (US)

(72) Inventor: Andrew Webber, Hockley, TX (US)

(73) Assignee: FORUM US, INC., Houston, TX (US)

( * ) Notice: Subject to any disclaimer, the term of this patent is extended or adjusted under 35 U.S.C. 154(b) by 0 days.

(21) Appl. No.: 15/815,981

(22) Filed: Nov. 17, 2017

(65) Prior Publication Data

US 2019/0153847 A1 May 23, 2019

(51) Int. Cl.

| | |
|---|---|
| ***E21B 43/08*** | (2006.01) |
| ***E21B 43/38*** | (2006.01) |
| ***E21B 27/00*** | (2006.01) |
| ***E21B 34/08*** | (2006.01) |
| ***E21B 43/12*** | (2006.01) |
| *E21B 34/00* | (2006.01) |

(52) U.S. Cl.

CPC ..... *E21B 43/38* (2013.01); *E21B 27/005* (2013.01); *E21B 34/08* (2013.01); *E21B 43/08* (2013.01); *E21B 43/126* (2013.01); *E21B 2034/002* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,431,963 | A * | 2/1984 | Walkow | C23F 13/04 204/404 |
| 4,522,264 | A * | 6/1985 | McNeer | E21B 43/045 166/131 |
| 4,702,313 | A * | 10/1987 | Greenlee | E21B 23/01 166/216 |
| 9,441,435 | B2 | 9/2016 | Leitch | |
| 2016/0341026 | A1 | 11/2016 | Leitch | |
| 2017/0152724 | A1 | 6/2017 | Cote et al. | |

OTHER PUBLICATIONS

PCT International Search Report/Written Opinion dated Feb. 19, 2019 for Application No. PCT/US2018/060276 (FETI/0196PC).

* cited by examiner

*Primary Examiner* — Giovanna C Wright
*Assistant Examiner* — Ronald R Runyan
(74) *Attorney, Agent, or Firm* — Patterson + Sheridan, LLP

(57) ABSTRACT

A sand guard system having an outer housing, a wedge assembly disposed in the outer housing, and an inner tube disposed in the outer housing such that an annulus is formed between the inner tube and the outer housing. The wedge assembly comprises a plurality of wedges coupled together by one or more flexible retaining members such that the wedges are movable radially outward and inward relative to the outer housing. The inner tube has a plurality of slots configured to filter out solids from fluids flowing from the annulus into the inner tube through the slots.

14 Claims, 6 Drawing Sheets

SANDGUARD FOR A PROGRESSIVE CAVITY PUMP

BACKGROUND

Field

Embodiments of the disclosure generally relate to a downhole system configured to prevent sand from settling on a downhole pump during pump shutdown.

Description of the Related Art

Downhole pumps, such as progressive cavity pumps, are used for the production of hydrocarbons to surface from significant wellbore depths. A progressive cavity pump is typically attached to the bottom end of production tubing, and has a rubber stator having a helical internal profile which mates with a rotor having an external screw profile. The rotor is connected to a rotating pump rod, which extends through the production tubing and is driven by a surface motor.

Progressive cavity pumps are sensitive to sands and other abrasive solids commonly present in the production fluid. The amount of sand which is produced from a well depends on characteristics of the formation, and various methods are used to control sand production. Problems can arise when the pump is shut down after a period of pumping fluid up the production tubing to surface. On pump shutdown, flow ceases very quickly as the fluid levels in the production bore and the annulus equalize. Gravity acting on the sand particles present in the column of fluid above the pump (which could be several thousand meters) causes the sand and any other solids to fall back towards the pump.

Due to the complex configuration of the pump, there is no direct path for the sand to pass through, and therefore it tends to settle on top of the pump and/or fills up a helical path between the pump rod and the pump stator, potentially causing it to be unable to rotate. When production operations are resumed, a higher load is required to start the pump and push the sand up from the pump. In some cases this can cause breaking of the rotor shaft of the progressive cavity pump. Such failure requires work-over involving pull-out and reinstallation, which is an expensive and time-consuming operation.

Therefore there is a need for new and improved systems configured to prevent sand from settling on downhole pumps during pump shutdown.

SUMMARY

In one embodiment, a sand guard system comprises an outer housing; a wedge assembly disposed in the outer housing, wherein the wedge assembly comprises a plurality of wedges coupled together by one or more flexible retaining members such that the wedges are movable radially outward and inward relative to the outer housing; and an inner tube disposed in the outer housing such that an annulus is formed between the inner tube and the outer housing, wherein the inner tube has a plurality of slots configured to filter out solids from fluids flowing from the annulus into the inner tube through the slots.

In one embodiment, a hydrocarbon production system comprises production tubing; a sand guard system coupled to the production tubing; and a downhole pump coupled to the production tubing below the sand guard system.

BRIEF DESCRIPTION OF THE DRAWINGS

The appended drawings illustrate only typical embodiments and are therefore not to be considered limiting of the scope of the disclosure.

To facilitate understanding, identical reference numerals have been used, where possible, to designate identical elements that are common to the figures. It is contemplated that elements disclosed in one embodiment may be beneficially utilized with other embodiments without specific recitation.

DETAILED DESCRIPTION

Embodiments of the disclosure relate to a hydrocarbon production system having a production tubing, a sand guard system coupled to the production tubing, and a downhole pump coupled to the production tubing below the sand guard system. The sand guard system is installed above the downhole pump, which may be a progressive cavity pump, to prevent solids, such as sand, from settling on the downhole pump during pump shutdown. The sand guard system is configured to filter, divert, and collect solids that are entrained in production fluids pumped to surface by the downhole pump. The sand guard system is also configured to allow a pump rod having enlarged couplings to be safely lowered through the sand guard. For example, a 1-inch diameter pump rod having 2-inch diameter couplings can be safely lowered through the sand guard system.

Figure 1:
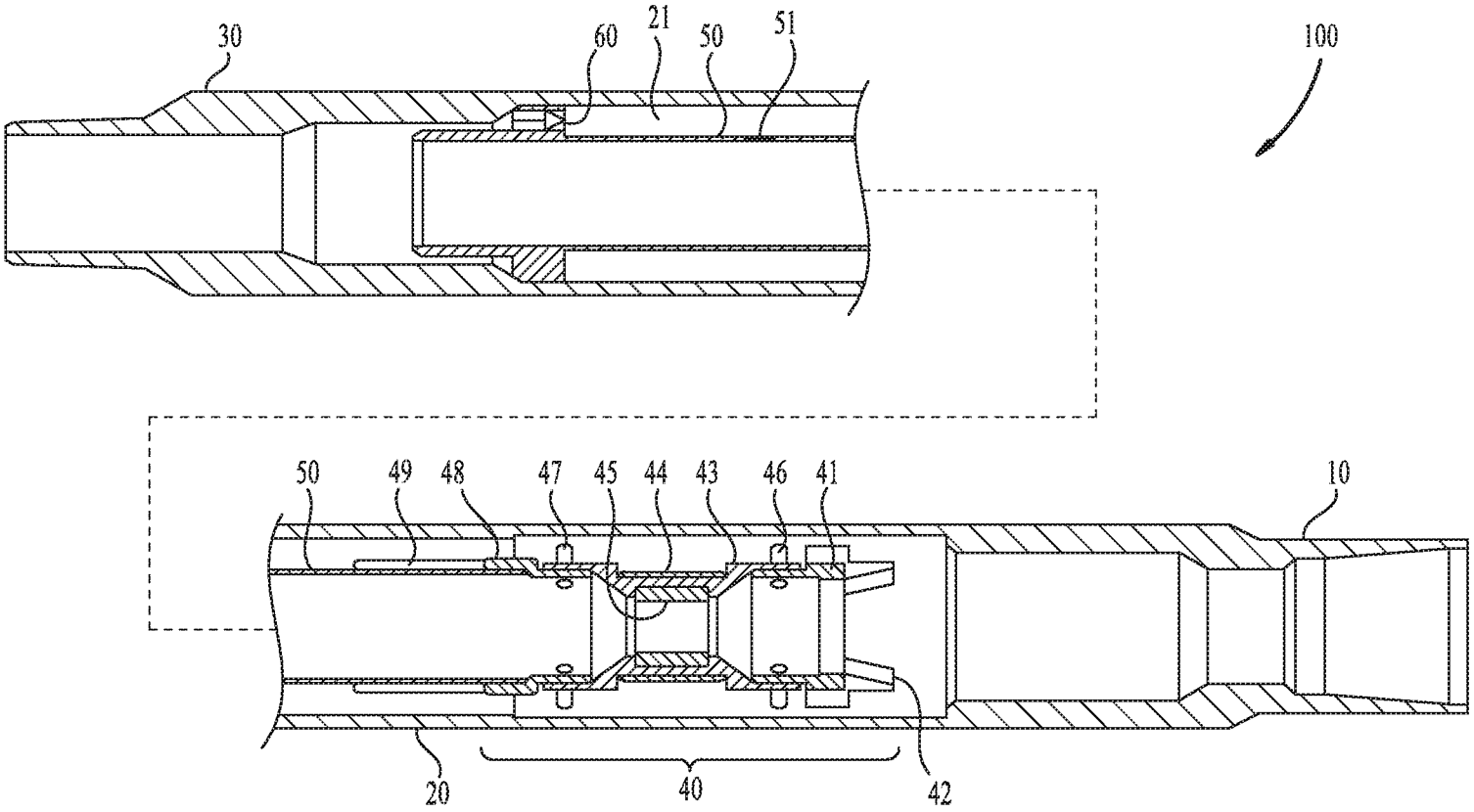
FIG. 1 is a sectional view of a sand guard for a progressive cavity pump according to one embodiment.

FIG. 1 is a sectional view of a sand guard 100 according to one embodiment. The sand guard 100 includes a top sub 10 and a bottom sub 30 coupled at opposite ends to an outer housing 20. Although the top sub 10 and the bottom sub 30 are shown being formed as a single piece with the outer housing 20, the top sub 10 and/or the bottom sub 30 may be separate components that are threadedly coupled to the ends of the outer housing 20.

The sand guard 100 further includes a wedge assembly 40 that is located within the outer housing 20 and is coupled to one end of an inner tube 50. The wedge assembly 40 includes an upper seat 41 and a lower seat 48 coupled at opposite ends to a plurality of wedges 43. In particular, the upper seat 41 and the lower seat 48 are at least partially inserted into opposite ends of the wedges 43. The wedges 43 are held together by one or more flexible retaining members 44, which may be springs or bands. An elastomer 45 is coupled to the inner surfaces of the wedges 43. For example, the elastomer 45 may be bonded to the wedges 43 or may be spring mounted inside the wedges 43 so that it has a small amount of radial movement relative to the wedges 43. A plurality of guide fins 42 are coupled to the upper seat 41 on one side.

A first set of guide pins 46 are disposed through the upper seat 41 and the wedges 43 to support the upper end of the wedge assembly 40 within the outer housing 20. A second set of guide pins 47 are disposed through the lower seat 48 and the wedges 43 to support the lower end of the wedge assembly 40 within the outer housing 20. The wedges 43 can be moved radially outward and inward relative to the outer housing 20, as well as the upper and lower seats 41, 48, along the guide pins 46, 47 as further described below with respect to FIG. 3.

The lower seat 48 is coupled to the upper end of the inner tube 50. The lower seat 48 has a plurality of slots 49 formed about its circumference. The inner tube 50 is at least partially inserted into the lower seat 48 and blocks fluid flow through the slots 49 of the lower seat 48 when the wedge assembly 40 is in the closed position shown in FIG. 1.

An annulus 21 is formed between the outer surface of the inner tube 50 and the inner surface of the outer housing 20. The inner tube 50 has a plurality of slots 51 formed about the circumference that are configured to allow production fluids to flow between the interior of the inner tube 50 and the annulus 21. Although only one slot 51 is shown, the inner tube 50 may have any number, shape, and/or arrangement of slots 51 formed about the circumference of the inner tube 50. The slots 51 are also configured to filter out solids from production fluids by preventing solids from flowing into the interior of the inner tube 50 from the annulus 21.

A valve 60 is coupled to the lower end of the inner tube 50 near the bottom sub 30 and helps support the inner tube 50 within the outer housing 20. Although the valve 60 is shown as being formed as a single piece with the inner tube 50, the valve may be a separate component that is socket fit, e.g. pushed or press fit, onto the end of the inner tube 50. Although only a single valve is shown, the valve 60 may comprise one or more valves located about the circumference of the inner tube 50. The valve 60 is located between the inner tube 50 and the outer housing 20 and functions as a one-way valve, such as a check valve. The valve 60 allows fluid to flow into the annulus 21, while preventing fluid to flow out of the annulus 21 through the valve 60. According to one example, the valve 60 may comprise a housing having a plurality of fluid paths with ball valves located in each fluid path that open when fluid is flowing in one direction and close when fluid is flowing in the opposite direction.

Figure 2:
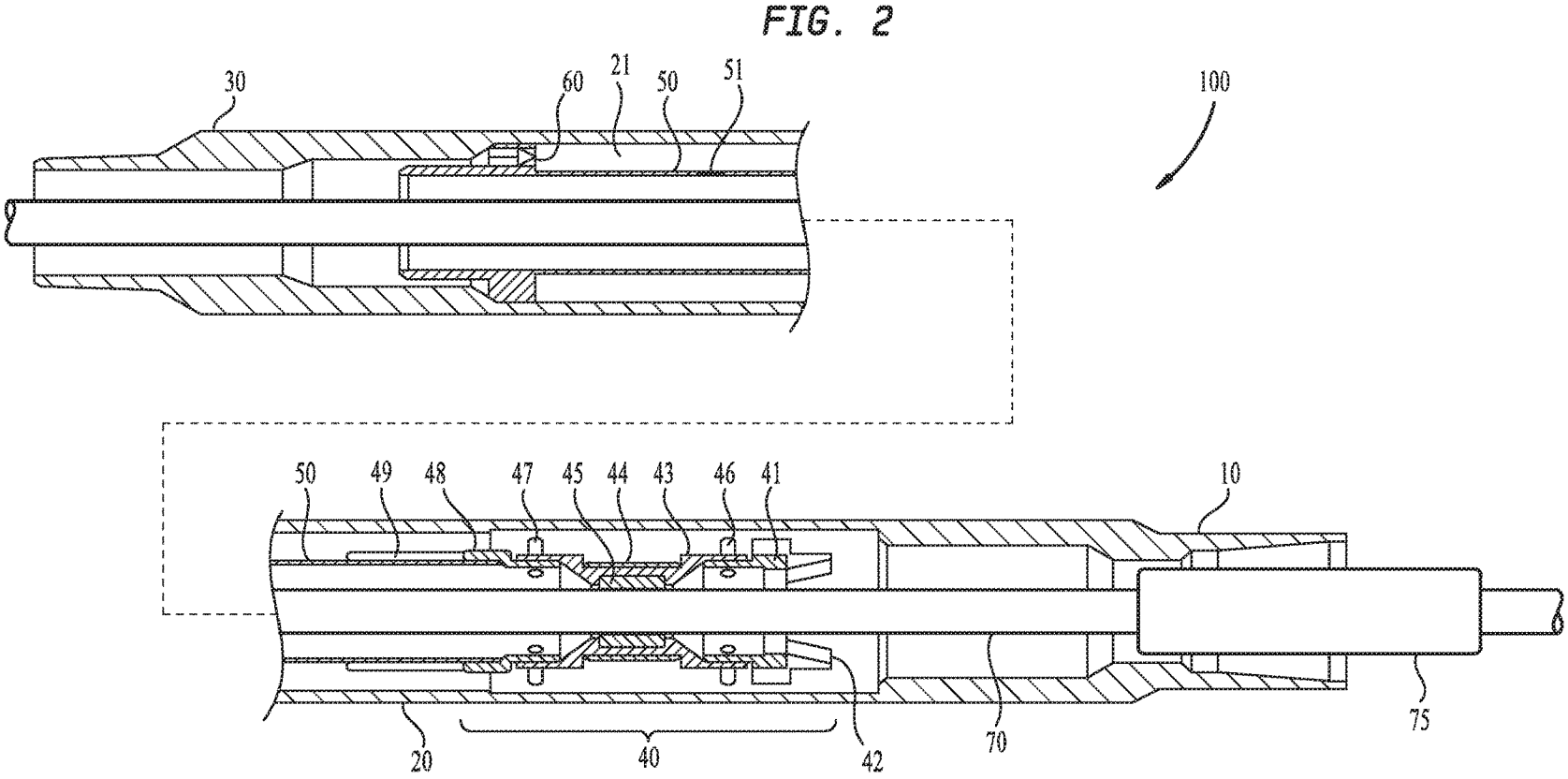
FIG. 2 is a sectional view of the sand guard with a pump rod extending through the sand guard in a first position.

FIG. 2 is a sectional view of the sand guard 100 with a pump rod 70 extending through the sand guard 100. After the downhole pump and the sand guard 100 are positioned in a wellbore, the pump rod 70 is subsequently lowered though the sand guard 100 and connected to the downhole pump to operate the downhole pump. The guide fins 42 located on the upper seat 41 of the wedge assembly 40 may help center the pump rod 70 when initially being lowered through the sand guard 100.

The wedge assembly 40 is biased inward by the flexible retaining members 44 so that the elastomer 45 remains in contact with the pump rod 70 as it is being lowered through the sand guard 100 and during operation to minimize or prevent any metal to metal contact with the remaining components of the sand guard 100, which may cause undue wear when the pump rod 70 is rotated. The force of the wedge assembly 40 on the pump rod 70 is an amount that does not unduly restrict rotation of the pump rod 70 relative to the sand guard 100. The pump rod 70 may include a string of rods that are connected end to end by coupling. As shown, the pump rod 70 has a coupling 75 that has a diameter greater than the diameter of the main body of the pump rod 70. Although only one coupling 75 is shown, the pump rod 70 may have multiple couplings 75 uniformly distributed along the length of the pump rod 70.

Figure 3:
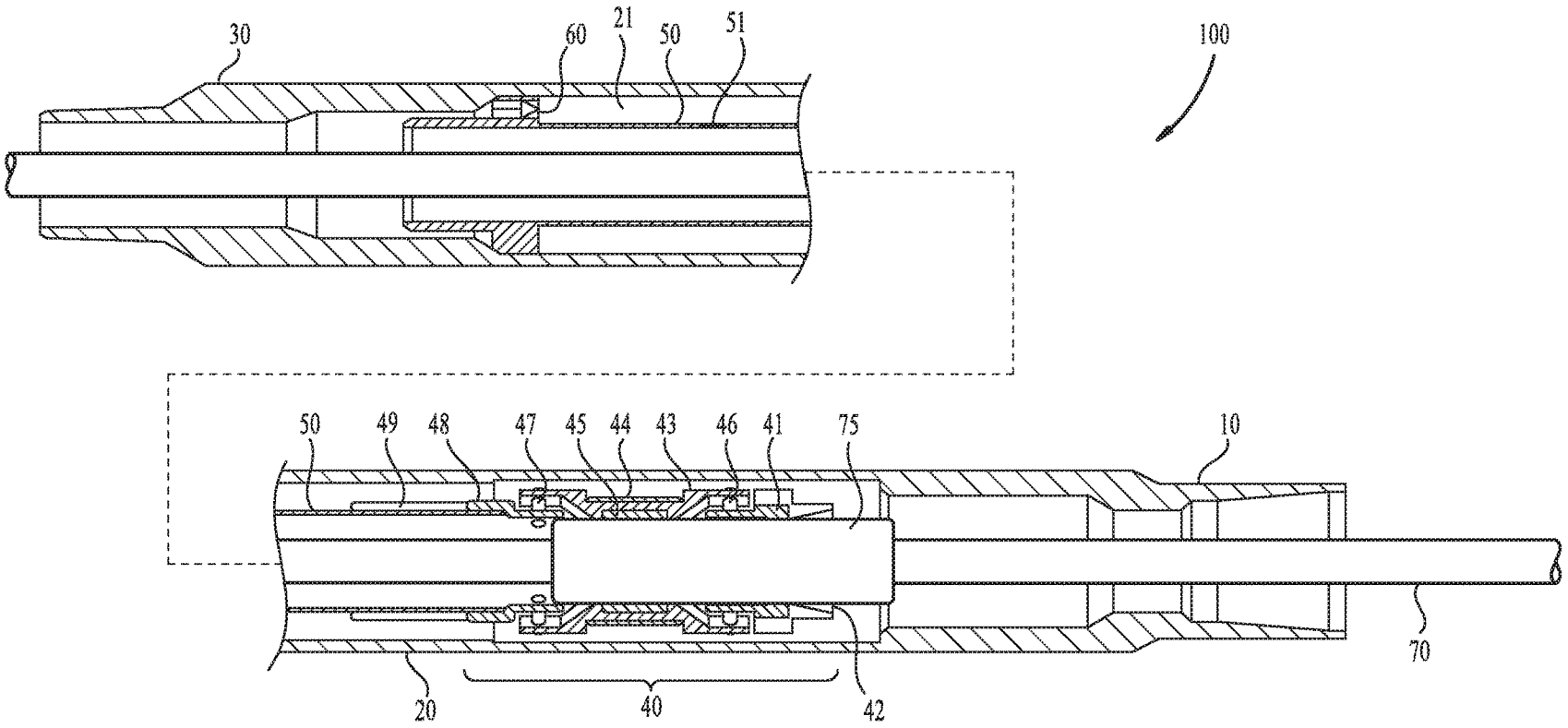
FIG. 3 is a sectional view of the sand guard with the pump rod extending through the sand guard in a second position.

FIG. 3 is a sectional view of the sand guard 100 as the coupling 75 of the pump rod 70 passes through the wedge assembly 40. The coupling 75 is lowered into the wedge assembly 40 and forces the wedges 43, as well as the flexible retaining members 44 holding the wedges 43 together, to move radially outward toward the outer housing 20. The force applied by the coupling 75 is sufficient to overcome any force applied by the flexible retaining members 44 to keep the wedges 43 together. The wedges 43 are moved radially outward along the first and second sets of guide pins 46, 47 relative to the upper and lower seats 41, 48 until the coupling 75 passes through the wedge assembly 40.

Figure 4:
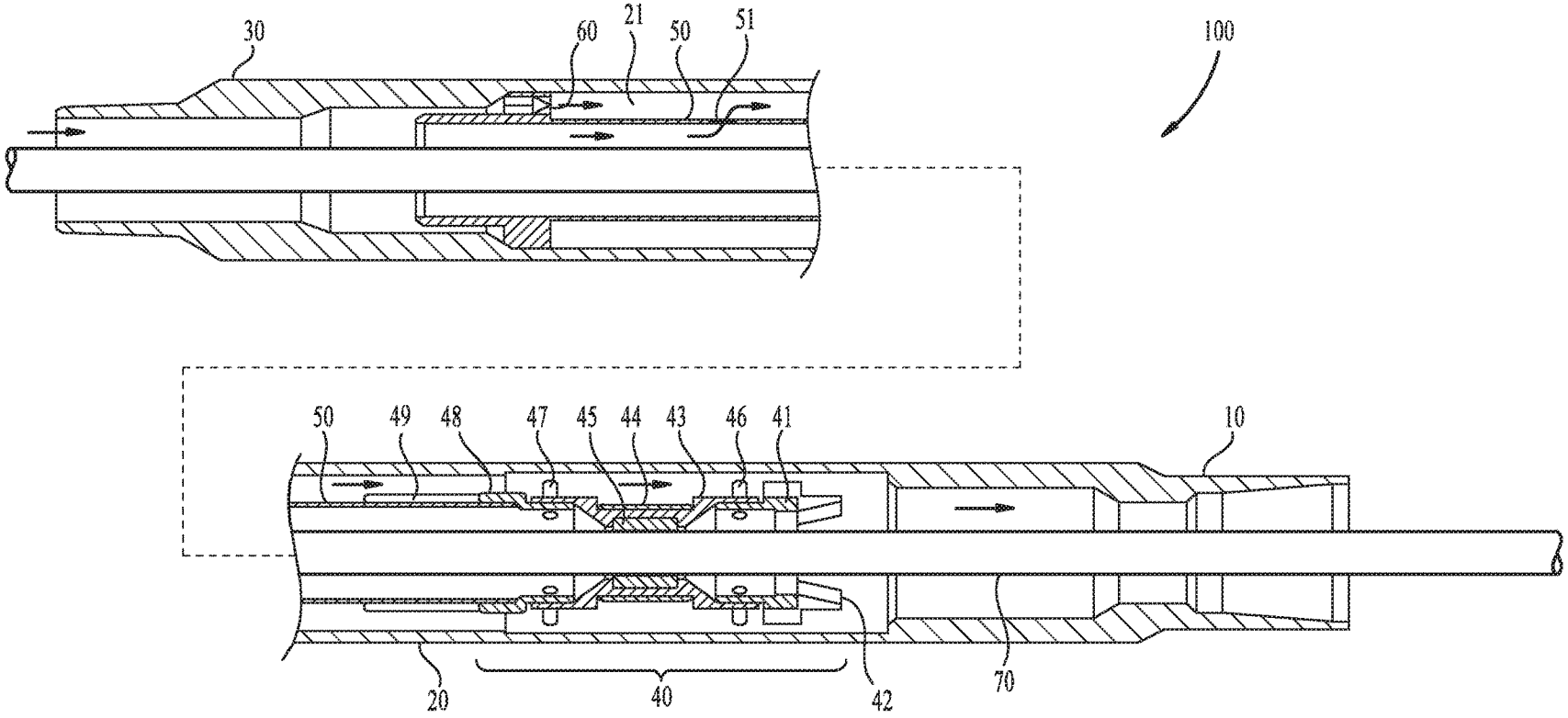
FIG. 4 is a sectional view of the sand guard with the pump rod extending through the sand guard during a pumping operation.

FIG. 4 is a sectional view of the sand guard 100 during a pumping operation and after the coupling 75 shown in FIG. 3 is moved through the wedge assembly 40 and out the lower end of the sand guard 100. After the coupling 75 shown in FIG. 3 passes through the wedge assembly 40, the flexible retaining members 44 force the wedges 43 back radially inward toward each other such that the elastomer 45 engages the main body of the pump rod 70. As stated above, the wedge assembly 40 is configured to be biased into contact with pump rod 70, but the biasing force is an amount that does not unduly restrict the rotation of the pump rod 70 relative to the sand guard 100. The pump rod 70 may be rotated from surface to operate a downhole pump located below the sand guard 100, which causes production fluids to flow upwards through the sand guard 100 as depicted by the direction of the flow arrows.

Production fluids initially flow into the bottom sub 30, and then flow up into the interior of the inner tube 50 and out into the annulus 21 through the slots 51 formed in the inner tube 50. The flexible retaining members 44 are configured to keep the wedges 43 together and the elastomer 45 in contact with the pump rod 70 with an amount of force sufficient to prevent production fluids from flowing up between the elastomer 45 and the pump rod 70. Production fluids may also flow directly into the annulus 21 through the valve 60. The production fluids in the annulus 21 flow into the top sub 10 and up to the surface.

Figure 5:
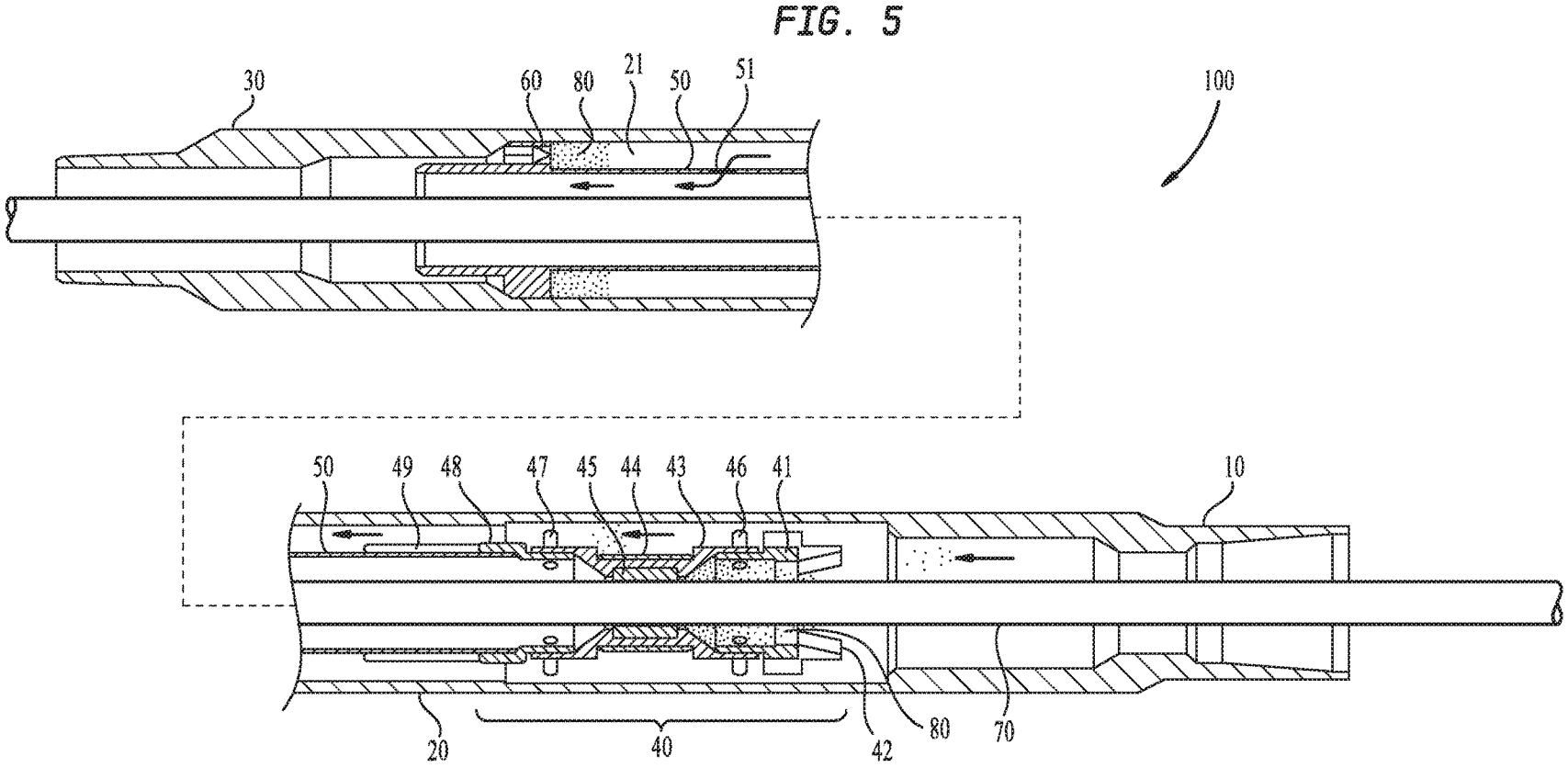
FIG. 5 is a sectional view of the sand guard with the pump rod extending through the sand guard during pump shutdown.

FIG. 5 is a sectional view of the sand guard 100 with the pump rod 70 extending through the sand guard 100 during pump shutdown. The pump rod 70 is not being rotated and production fluids are no longer being pumped upwards through the sand guard 100. Production fluids flow downwards in the sand guard 100 as depicted by the direction of the flow arrows until the fluid column in the production string equalizes with the fluid column in the wellbore annulus.

During this downward fluid flow, the flexible retaining members 44 continue to keep the wedges 43 together and the elastomer 45 in contact with the pump rod 70 with a sufficient amount of force to prevent the production fluids from flowing down between the elastomer 45 and the pump rod 70. The production fluids are diverted by the wedge assembly 40 into the annulus 21. From the annulus 21 the production fluids flow back into the interior of the inner tube 50 through the slots 51 formed in the inner tube 50. The slots 51 filter out any solids from the production fluids, and the solids are contained in the annulus 21. The valve 60 prevents fluid flow out of the annulus 21 and similarly diverts fluid flow into the slots 51.

When the fluid column is at rest and no longer flows through the sand guard 100, solids continue to fall through the production fluids by gravity acting on the solids. The solids are collected in the annulus 21 on top of the valve 60 as indicted by collected solids 80. Solids may also be collected in the upper area of the wedge assembly 40, specifically in the area above where the elastomer 45 and the pump rod 70 are in contact with each other as also indicated by collected solids 80.

After operation of the downhole pump has been resumed, production fluids may again freely flow upwards through the sand guard 100 and the collected solids 80 do not generate any significant back pressure on the fluid flow through the sand guard 100. Production fluids flowing up through the valve 60 into the annulus 21, as well as production fluids flowing through the slots 51 of the inner tube into the annulus 21, help lift and carry the collected solids 80 from the annulus 21 out through the top sub 10 and up to the surface. Similarly, the production fluids flow from the annulus 21 into the top sub 10 help lift and carry the collected solids 80 from the upper area of the wedge assembly 40. In this manner, the collected solids 80 are washed and cleaned out of the sand guard 100 when pumping is resumed.

In the event of a blockage, the sand guard 100 has two emergency features to help resume pumping or safe retrieval of the pump rod 70. A blockage may occur when an amount of fluid flowing up through the sand guard 100 exceeds the amount that the slots 51 in the inner tube and the fluid paths in the valve 60 can allow to pass through, such as by solids that accumulate in the annulus 21 and/or in the upper area of the wedge assembly 40 that partially or completely blocks fluid flow through the sand guard 100.

Figure 6:
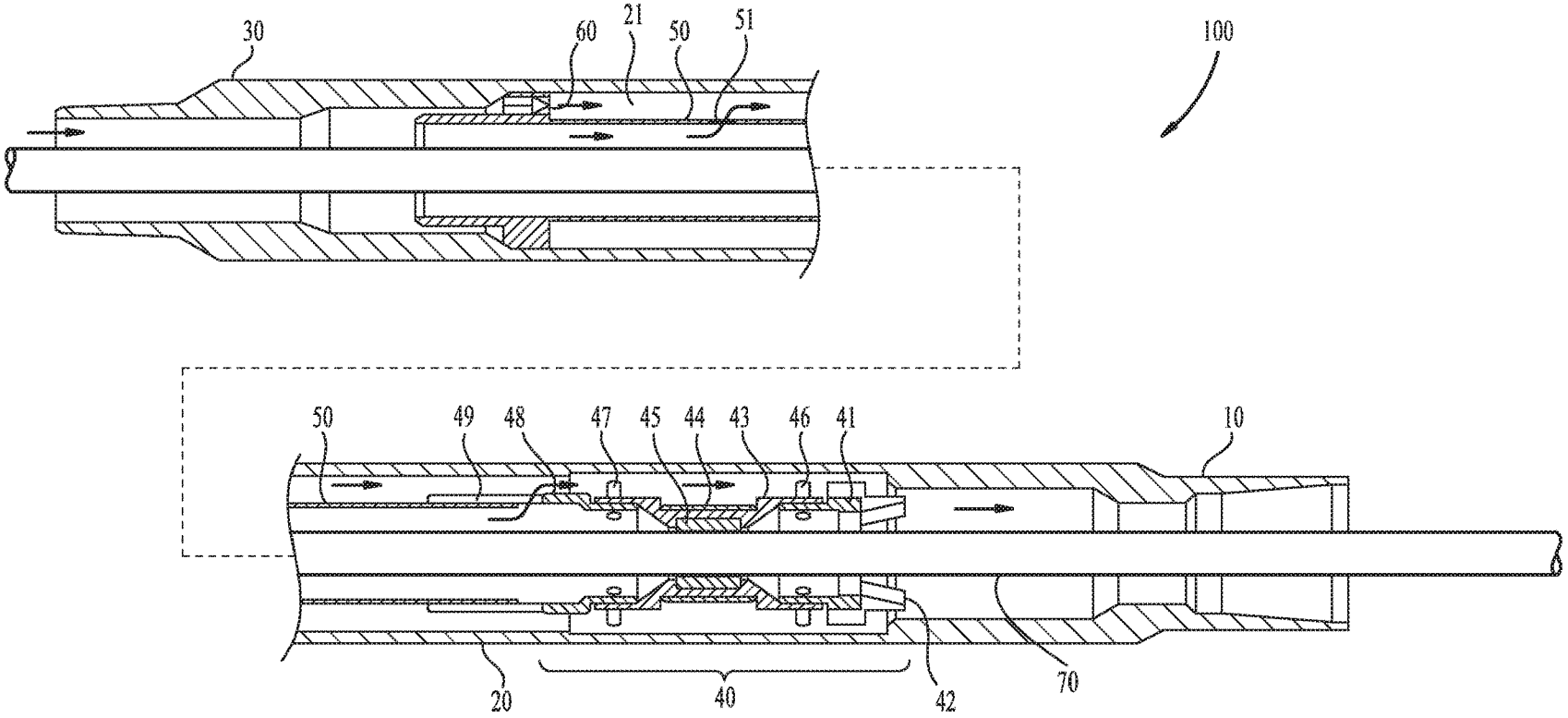
FIG. 6 is another sectional view of the sand guard with the pump rod extending through the sand guard during a pumping operation.

First, as shown in FIG. 6, the wedge assembly 40 is movable laterally relative to the inner tube 50, the outer housing 20, and the pump rod 70, and can be moved to an open position to allow fluid to flow up through the upper end of the inner tube 50 and out through the slots 49 of the lower seat 48 into the annulus 21. The pressure within the inner tube 50 can apply enough pressure to move the wedge assembly 40 laterally to expose the slots 49 of the lower seat 48 from behind the inner tube 50. Fluid flow out through the slots 49 can help wash and clean out any blockage due to build-up of solids in the annulus 21 and above the wedge assembly 40. The wedge assembly 40 may move back to the closed position where the slots 49 are closed off by the inner tube 50 by its weight due to gravity as the pressure is lowered and/or may optionally be biased back into a closed position by spring return.

Second, if enough pressure builds within the inner tube 50 and cannot flow out through the valve 60, the slots 51 of the inner tube 50, and the slots 49 of the lower seat 48, the pressure can apply enough force to wedges 43 radially outward (such as when the coupling 75 is being moved the wedge assembly 40 as shown in FIG. 3) to allow fluid to flow up and out between the elastomer 45 and the pump rod 70. The fluid flow can similarly help wash and clean out any blockage due to build-up of solids in the annulus 21 and above the wedge assembly 40.

These two emergency features helps prevent the sand guard 100 from being over pressurized to a point of failure and open alternative fluid paths that can help wash and clean out the solids from the sand guard 100 to resume pumping and or retrieve the pump rod 70.

The sand guard 100 as described herein provides a filter system which prevents solids in production fluids from settling on, or passing downwards through, a downhole pump. The sand guard 100 filters the solids in a way which does not provide a significant backpressure or resistance to subsequent operation of the downhole pump. In addition, the solids are collected in a manner which allows them to be lifted and carried with production fluid flow when pumping is resumed and therefore allows them to be washed and cleaned out of the sand guard 100. Lastly, the sand guard 100 has two emergency features to help continue pumping operations and/or retrieval of the pump rod 70 in the event of a blockage. This allows the sand guard 100 to be used for extended periods.

While the foregoing is directed to some embodiments, other and further embodiments may be devised without departing from the basic scope thereof, and the scope thereof is determined by the claims that follow.

The invention claimed is:

1. A sand guard system, comprising:
- an outer housing;
- a wedge assembly disposed in the outer housing, wherein the wedge assembly comprises:
  - a plurality of wedges coupled together by one or more flexible retaining members such that the wedges are movable radially outward and inward relative to the outer housing;
  - an upper seat at least partially inserted into one end of the wedges; and
  - a lower seat at least partially inserted into an opposite end of the wedges, wherein the wedges are movable radially relative to the upper and lower seats; and
- an inner tube disposed in the outer housing such that an annulus is formed between the inner tube and the outer housing, wherein the inner tube has a plurality of slots configured to filter out solids from fluids flowing from the annulus into the inner tube through the slots.

2. The system of claim 1, wherein the wedge assembly further comprises a first set of guide pins disposed through the upper seat and the wedges, and a second set of guide pins disposed through the lower seat and the wedges, wherein the wedges are moveable radially along the first and second set of guides.

3. The system of claim 2, wherein the wedge assembly further comprises an elastomer coupled to the inner surfaces of the wedges.

4. The system of claim 3, wherein the upper seat includes a plurality of guide fins.

5. The system of claim 3, wherein the lower seat is coupled to an upper end of the inner tube.

6. The system of claim 5, further comprising a valve coupled to a lower end of the inner tube and configured to allow fluid flow into the annulus and prevent fluid flow out of the annulus.

7. The system of claim 1, wherein the lower seat has a plurality of slots, and wherein the wedge assembly is movable laterally relative to the inner tube to allow fluid to flow up through the upper end of the inner tube and out through the slots of the lower seat.

8. The system of claim 1, wherein the flexible retaining members force the wedges radially inward together.

9. The system of claim 1, further comprising a top sub and a bottom sub coupled at opposite ends of the outer housing.

10. A hydrocarbon production system, comprising:
- a production tubing;
- a sand guard system according to claim 1 coupled to the production tubing; and
- a downhole pump coupled to the production tubing below the sand guard system.

11. The system of claim 10, further comprising a pump rod extending through the sand guard system and connected to the downhole pump.

12. The system of claim 11, wherein the pump rod includes an enlarged coupling, and wherein the enlarged coupling is movable through the wedge assembly of the sand guard system.

13. The system of claim 12, wherein the downhole pump is a progressive cavity pump.

14. The system of claim 13, wherein the pump rod is rotatable relative to the sand guard system to operate the pump.

* * * * *